US005303520A

United States Patent [19]

Gozdziak

[11] Patent Number: 5,303,520

[45] Date of Patent: Apr. 19, 1994

[54] BRACE FOR REINFORCING ROOF ATTACHMENT

[76] Inventor: George Gozdziak, 22W511 S. 75th St., Naperville, Ill. 60540

[21] Appl. No.: 986,780

[22] Filed: Dec. 8, 1992

[51] Int. Cl.[5] ..... E04B 1/38; E04B 7/04

[52] U.S. Cl. ..... 52/92.2; 52/698; 52/713; 403/59

[58] Field of Search ..... 52/702, 92.1, 92.2, 52/92.3, 93.1, 93.2, 640, 643, 698, 713; 403/232.1, 59, 60; 248/237

[56] References Cited

U.S. PATENT DOCUMENTS 2,550,625 4/1951 Vick ..... 403/59
3,423,898 1/1969 Tracy et al. ..... 52/92.2
4,158,940 6/1979 Lancelot, III et al. ..... 52/702
4,449,335 5/1984 Fahey ..... 52/92.2

FOREIGN PATENT DOCUMENTS 2222221 2/1990 United Kingdom ..... 403/232.1

*Primary Examiner*—Michael Safavi
*Attorney, Agent, or Firm*—Douglas B. White

[57] ABSTRACT

A brace for use in the construction industry includes a pivoting joint and attachment brackets for securing rafters to wall members. An upper bracket attaches to the rafters, a lower bracket attaches to the wall members, and the pivoting joint acts to accommodate the roof pitch.

2 Claims, 2 Drawing Sheets

BRACE FOR REINFORCING ROOF ATTACHMENT

BACKGROUND OF THE INVENTION

1. Field of the Invention

The present invention relates generally to construction apparatus for joining and reinforcing structural members. More particularly this invention relates to a novel brace for reinforcing the joint of the roof to the wall.

2. Description of the Prior Art

In the prior art many construction aids have been presented to assist the joining of structural members, and these have exclusively been rigid braces and brackets which attach to the structural members. However, no brace has been proposed for joining the rafters of a roof to the wall members, such as the wall plate and tie beam. Moreover, no device has been presented which is able to effectively accommodate the varying roof slopes encountered in the construction industry.

SUMMARY OF THE INVENTION

The present invention includes a pivoting joint connecting upper and lower attachment brackets for securing rafters to wall members. The upper bracket attaches to the rafters and the lower bracket attaches to the wall member, while the pivoting joint acts to accommodate the varying roof pitch.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
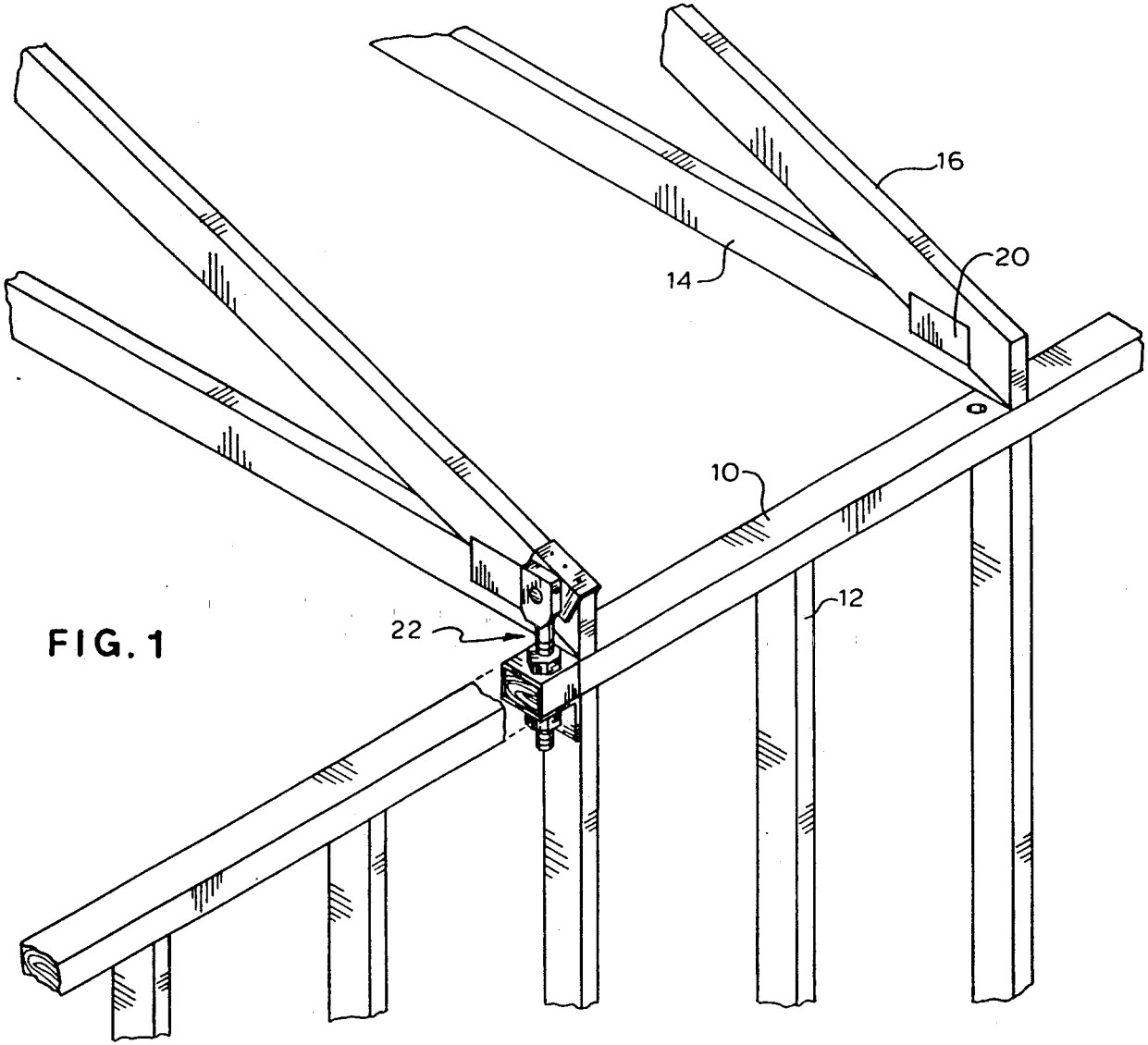
FIG. 1 is a pictorial view of the brace of the present invention shown in place reinforcing the roof attachment to the wall.

Turning first to FIG. 1 there is shown a wall and roof construction including a wall plate member 10, wall studs 12, tie beams 14, and rafters 16. Typically the rafter and tie beam are joined by brackets 20 to form a truss, and fastened to the wall plate by nails. In accordance with the present invention, the tie beam and rafter connection to the wall plate is further reinforced by a brace 22.

Threaded nuts 44 and 36 are carried on a threaded bolt 50 which is secured at its uppermost extremity to the rafter bracket 30 by pivot connection 52. This connection employs a block member 54 having a threaded recess for receipt of the bolt 50 and having a rotatable pin 56 for securing the block to the rafter bracket.

Figure 2:
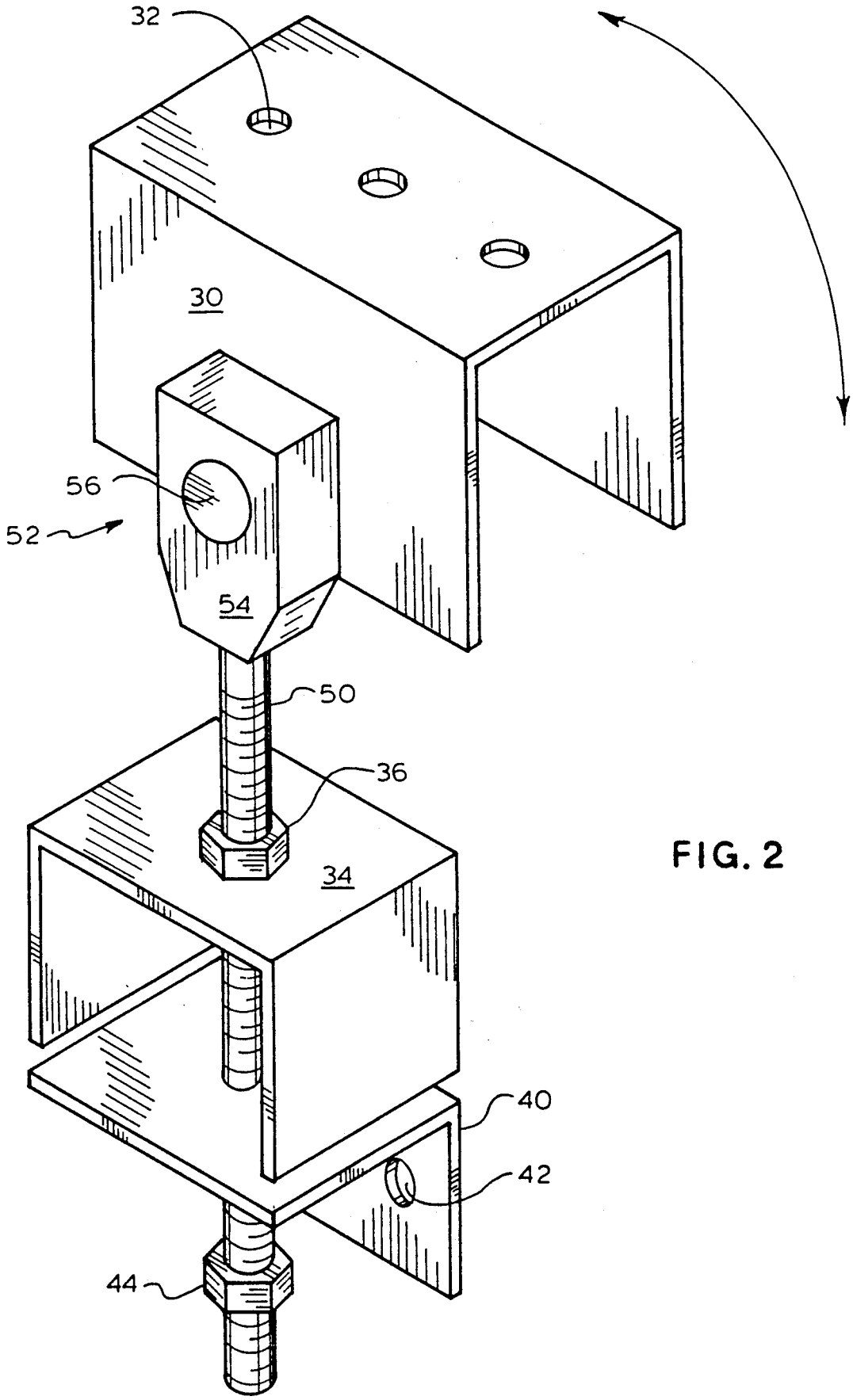
FIG. 2 is a perspective view of the brace of FIG. 1.

The brace 22 of the present invention is shown in detail in FIG. 2. A short section of a metal channel forms the rafter bracket 30 and is employed to secure the brace to the rafter by nails at nail holes 32. Attachment to the wall plate is provided by the wall plate bracket 34 (also a metal channel) which partially envelops the wall plate member and is secured against the wall plate by threaded nut 36. Further securing the brace is the wall stud attachment bracket 40 (metal "L" bracket) which attaches to the wall stud 12 via nail holes 42 and is further held against the wall plate by threaded nut 44. The combination of the wall plate bracket 34 and the wall stud bracket 40 acts to clamp the wall plate member 10 therebetween and to further secure it to the wall stud.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Apparatus for reinforcing the attachment of a roof structural member to a wall structural member comprising:

a first bracket for attachment to said roof structural member;

a second bracket for attachment to said wall structural member, said second bracket comprising a metal channel member and a metal "L" bracket arranged to clamp said wall structural member therebetween; and a pivotal joint for joining said first bracket to said second bracket, said pivotal joint comprising a block member rotatably mounted to said first bracket and a bolt member affixed to said block member and affixed to said second bracket.

2. The apparatus for reinforcing the attachment of a roof structural member to a wall structural member of claim 1 wherein said "L" bracket is adapted to be affixed to vertical wall stud members.

* * * * *